US007033247B2

(12) United States Patent
Zhang et al.

(10) Patent No.: US 7,033,247 B2
(45) Date of Patent: Apr. 25, 2006

(54) ELECTRIC SHARPENER

(75) Inventors: Ross Zhang, Qingdao (CN); Ning Dai, Qingdao (CN)

(73) Assignee: Qingdao D&D Electro Mechanical Technologies Co., Ltd., Qingdao (CN)

( * ) Notice: Subject to any disclaimer, the term of this patent is extended or adjusted under 35 U.S.C. 154(b) by 0 days.

(21) Appl. No.: 10/935,663

(22) Filed: Sep. 7, 2004

(65) Prior Publication Data

US 2005/0090184 A1 Apr. 28, 2005

(30) Foreign Application Priority Data

| | | |
|---|---|---|
| Sep. 8, 2003 | (CN) | 03 2 53352 |
| Jul. 30, 2004 | (CN) | 2004 2 0052768 |
| Jul. 30, 2004 | (CN) | 2004 2 0052769 |
| Jul. 30, 2004 | (CN) | 2004 2 0052770 |
| Aug. 2, 2004 | (CN) | 2004 2 0052804 |
| Aug. 2, 2004 | (CN) | 2004 2 0052805 |
| Aug. 2, 2004 | (CN) | 2004 2 0052806 |
| Aug. 2, 2004 | (CN) | 2004 2 0052807 |
| Aug. 9, 2004 | (CN) | 2004 2 0053005 |

(51) Int. Cl.
*B24B 3/55* (2006.01)

(52) U.S. Cl. ..... 451/5; 451/11; 451/45

(58) Field of Classification Search ..... 451/11, 451/45, 65, 195, 196, 224, 229, 349, 5
See application file for complete search history.

(56) References Cited

U.S. PATENT DOCUMENTS

| | | | | |
|---|---|---|---|---|
| 6,572,448 | B1 * | 6/2003 | Bauer | 451/29 |
| 6,623,340 | B1 * | 9/2003 | Jansson | 451/241 |
| 6,676,495 | B1 * | 1/2004 | Siemers et al. | 451/278 |
| D490,522 | S * | 5/2004 | Jansson | D24/124 |
| D505,683 | S * | 5/2005 | Pfaff | D15/124 |

* cited by examiner

*Primary Examiner*—Lee D. Wilson
*Assistant Examiner*—Anthony Ojini
(74) *Attorney, Agent, or Firm*—Milde & Hoffberg, LLP

(57) ABSTRACT

The invention relates an electric sharpener, comprises a main frame, a main shaft, a motor, a transmission wheel, a grinding stone, and an electric control circuit. The motor is mounted on an angular frame which in turn is mounted on the main frame. The transmission wheel is fixed to an end of the main shaft, and the output shaft of the motor is tightly pressed against the periphery of the transmission wheel so as to drive it. A tool rest is fixed onto the main frame in a vertical or horizontal mounting orientation. A water vessel is fixed to the main frame, and the lower portion of the grinding stone dips into the water contained in the water vessel. Special clamps and attachments for grinding different tools are provided. The electric sharpener can be used for grinding various woodworking or household tools.

6 Claims, 7 Drawing Sheets

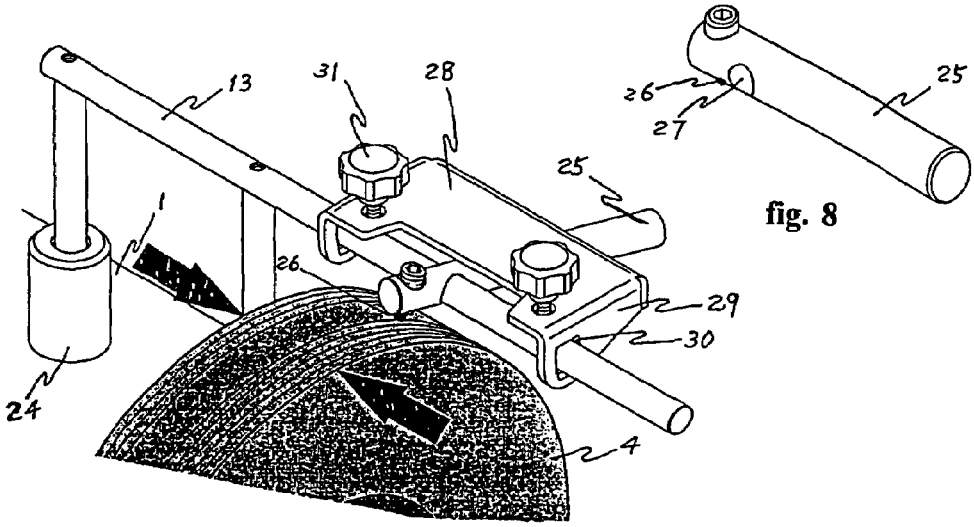
fig. 8
fig. 9
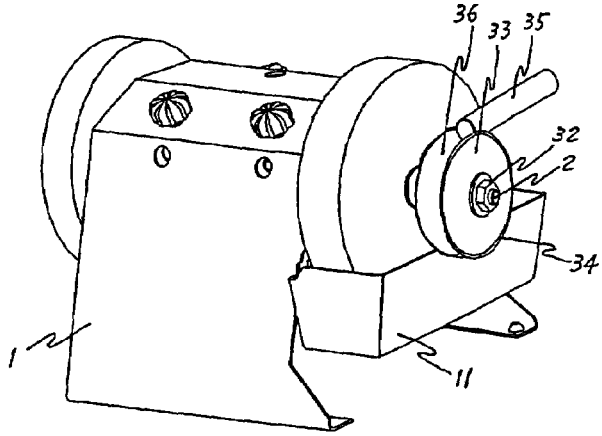
fig. 10
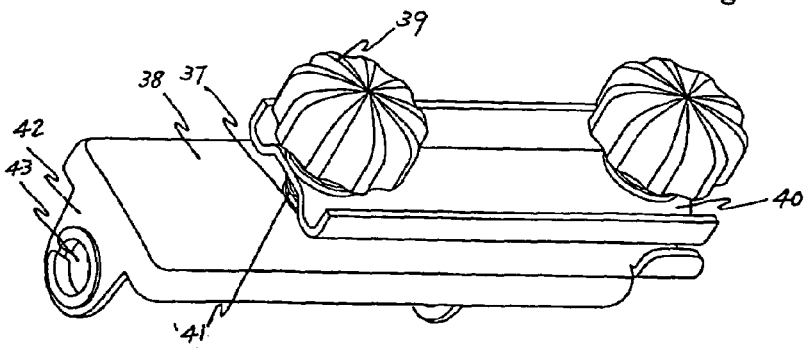
fig. 11

ELECTRIC SHARPENER

TECHNICAL FIELD

The invention relates to an electric sharpener which can be used for grinding various woodworking or household tools, such as lather tools, planer tools, scissors, chisels, axes, flat shovels, and round shovels, and in which the grinding stone can be polished and trimmed.

BACKGROUND ART

Conventionally, abrasive grinding stones and bench grinders are known as sharpeners for sharpening woodworking or household tools by grinding them. Abrasive grinding stones are operated by hand, and the grinding quality varies with the operators and is directly depended upon the skill of the operators. Further, abrasive grinding stones have different materials and grain sizes, which may be not matched with the tools to be grinded. So, abrasive grinding stones are less desired for their tool grinding quality, grinding efficiency and labour consumption.

Two types of bench grinders are available. The first type is called as manual bench grinders. During operation, an operator rotates the bench grinder by his one hand and holds the tool to be grinded by his another hand. It is difficult for the operator to coordinate the actions of his two hands, and thus, the grinding quality can not be ensured. The other type of bench grinder is electric bench grinder, which generally includes a belt driving system. Electric bench grinders are suffered from their complicated structure, bulk size, as well as high vibration and noise created during operation. In addition, known electric bench grinders are not equipped with special clamps and attachments for grinding different tools. During operation, the tool to be grinded is hold by the operator and biased against the grinding stone which is rotated in a high speed, rather than being positioned and clamped by a clamp or attachment. The tool held by hand is likely to move and vibrate, and the grinding angle of the tool is set only by the operator's eyesight. Therefore, the grinding angle and quality can not be ensured. Further, as the grinding stone rotates in a high speed, it requires that the operator paying more attention; otherwise, the grinding quality may be affected and the tool may be damaged.

DISCLOSURE OF THE INVENTION

An object of the invention is to overcome the above mentioned defects and to provide an improved electric sharpener which can be widely used for grinding various woodworking or household tools such as lather tools, planer tools, scissors, chisels, axes, round shovels and flat shovels, and in which the grinding stone can be polished and trimmed. It is desired that the sharpener may providing one or more of the following advantages: having a simple, proper, compact and down-sized transmission system; creating less vibration and noise during operation; being able to be fitted with various clamps and attachments; being able to positively position and clamp the tools to be sharpened; providing a desired grinding angle and grinding quality; having a high grinding efficiency; and being easy to operate.

In order to achieve one or more of the above mentioned objects, the invention provides an electric sharpener, comprising: a main frame; a main shaft and a motor mounted on the main frame; a transmission wheel fixed to the main shaft; a grinding stone mounted on the main shaft; and an electric control circuit; wherein the motor is mounted on an angular frame having two legs, the end of each leg is provided with a mounting hole, through which a pivot shaft is inserted, the pivot shaft is pivotably mounted on the main frame, so that the motor may pivot about the pivot shaft; and the output shaft of the motor, owing to its weight, is pressed against the periphery of the transmission wheel so as to drive it by friction force.

According to this electric sharpener, a transmission mechanism is formed by the transmission wheel. When the motor is rotated, the rotation of the output shaft of the motor is transmitted to the main shaft by friction force, for driving the grinding stone. The transmission mechanism does not include a driving belt, which result in a simple, proper, compact and down-sized transmission mechanism. Further, this transmission mechanism can provide a slippage effect. That is to say, when the load applied to the grinding stone is too large, slippage will appeared between the output shaft of the motor and the transmission wheel, and the rotation speed of the grinding stone will be dropped, so as to protect the electric sharpener.

A water vessel may be fixed to the main frame, and the lower portion of the grinding stone dips into the water contained in the water vessel. The grinding stone will be wetted by the water, so that the grinding stone and the tool being grinded may be cooled, which facilitates the grinding process.

The electric sharpener may further comprise a cantilever type tool rest which is fixed to the main frame. Preferably, the tool rest includes a long transverse bar and a plurality of legs perpendicularly extended from the transverse bar; in addition, a plurality of mounting holes are formed in the upper surface and the back surface of the main frame, and a plurality of inserting holes are formed in the upper surface and the front surface of the main frame; a supporting frame is fixed in the main frame, wherein a plurality of threaded bores, which are coaxial with the inserting holes, are formed in the upper surface and the front surface of the supporting frame, with the central axes of the threaded bores being perpendicular to that of the corresponding mounting holes, and a plurality of additional mounting holes, which are coaxial with the mounting holes, are formed in the upper surface and back surface of the supporting frame; and the legs are inserted through the corresponding mounting holes and the corresponding additional mounting holes, with the end portions of the legs exposed in the inside of the supporting frame, a plurality of fastening screws are inserted through the inserting holes, and are engaged into the corresponding threaded bores, with the end portions of the fastening screws exposed in the inside of the supporting frame and forcefully pressed against the end portions of the legs of the tool rest, so as to fasten the tool rest onto the supporting frame in different mounting orientations, which include at least a vertical and a horizontal mounting orientations. According to this structure, the tool rest onto the supporting frame in a vertical and a horizontal mounting orientations, as well as other mounting orientations. Therefore, if required, various clamps and attachments may be easily mounted on the tool rest. The distance between the transverse bar of the tool rest and the main frame may be adjusted and set by the fastening screws.

The mounting structure of the tool rest as described above may be replaced by other structures. For instance, each of the upper surface and the back surface of the main frame may be fixedly provided with leg mounting bases each having a leg mounting hole. The lower end of each of the legs of the tool rest is inserted into a corresponding leg mounting hole of the leg mounting base and is fastened by a corresponding fastening screw.

In the sharpening process, the tool being grinded is clamped by a corresponding clamp, so as to positively bias the tool against the grinding stone. The tool may be grinded with high quality.

Preferably, the periphery of the transmission wheel is covered with a rubber layer. In this case, the friction force may be increased, and the transmission efficiency is also increased. Meanwhile, the vibration and the noise created in the operation will be reduced.

Preferably, a leather honing wheel is mounted on the main shaft, and the outer periphery of the leather honing wheel is covered with a layer of leather. The leather honing wheel is used to remove the void portions and the barbs of the tool edge.

In a preferred embodiment of the invention, an axe clamp is mounted on the tool rest, and the axe clamp comprises: a base plate part; right and left side plate parts continued to the side edges of the base plate part, the right and left side plate parts each has a through hole by which the corresponding side plate part may be mounted on the tool rest, with the two through holes being coaxially arranged; an upper bent plate part continued to the upper edge of the base plate part; and a tongue plate part continued to front edge of the upper bent plate part and bent in a front downward direction, an axe may be clamped in the axe clamp by a pressing force created by the base plate part and the tongue plate part.

In the sharpening process, the transverse bar of the tool rest is inserted in the two through holes, and the axe is clamped in the axe clamp with the cutting edge of the axe being biased onto the grinding stone. As the axe clamp and the axe reciprocally moving on the tool rest, the cutting edge of the axe is grinded by the rotated grinding stone. The displacement and vibration of the axe will be avoided, and a high grinding quality and a high efficiency will be obtained.

In another preferred embodiment of the invention, a stone trimmer for trimming the outer periphery of the grinding stone is mounted on the tool rest, and the stone trimmer comprises: a lever, which is slidably and pivotably mounted on the transverse bar of the tool rest; and a diamond cutting head fixed to a longitudinal end of the lever; wherein the diamond cutting head protrudes downwardly under the lever and contact with the grinding stone to be trimmed; and a support strap is fixed onto the tool rest above the stone trimmer, so as to define a limited vertical pivot position for the stone trimmer.

In the stone trimming process, the horizontal position of the diamond cutting head is adjusted, and the cutting head is manually biased against the outer periphery of the rotated grinding stone. After a part of the outer periphery of the grinding stone has been trimmed by the cutting head, the cutting head is moved horizontally on the transverse bar of the tool rest, for trim another part of the grinding stone. The vertical position of the stone trimmer is limited by the support strap. Therefore, the diamond cutting head may evenly cut into the outer periphery surface of the grinding stone, so as to avoid the random displacement and vibration which may be met when holding the stone trimmer only by hand. As a result, the grinding stone may be trimmed to have a shape of a high quality with high trimming efficiency.

Preferably, a profiled polishing disc is mounted on the main shaft, and the profiled polishing disc has a disc body and a leather layer which covers the outer periphery of the disc body. The leather, preferably cow leather, has a high toughness, a high mechanical strength, and a high wearing resistance, which result in a long service life. Meanwhile, as the leather has a high material quality in addition to its high mechanical strength, the third embodiment may provide an excellent polishing effect.

In another preferred embodiment of the invention, the tool rest of the electric sharpener is equipped with a clamp for woodworking lather tool, this clamp comprises: a base plate having a plurality of threaded bores formed therethrough; a plurality of knobs each having a threaded lower portion for engaged in a corresponding threaded bore of the base plate; a pressing plate mounted between a shoulder portion of the knobs and the upper surface of the base plate; and a plurality of compressing springs each surrounding the threaded lower portion of a corresponding knob between the pressing plate and the base plate; wherein the base plate includes right and left supports protruded downwardly from it, each of the right and left supports has a through hole for mounting the clamp to the tool rest.

In the sharpening process, a woodworking lather tool is clamped between the base plate and the pressing plate with the cutting edge of the lather tool being biased onto the grinding stone. As the clamp and the lather tool reciprocally moving on the tool rest, the cutting edge of the lather tool is grinded by the rotated grinding stone. The displacement and vibration of the lather tool will be avoided, and a high grinding quality and a high efficiency will be obtained.

In another preferred embodiment of the invention, the tool rest of the electric sharpener is equipped with a general shovel clamp, the clamp comprises: a support frame which has two coaxial through holes for mounting the support frame to the tool rest; a ring body secured to the support frame by a fastening screw; an anvil block fixed in the ring body by a sunk screw; a knob engaged in a threaded bore provided through the ring body; and a pressing block connected to the knob and faced to the anvil block for clamping a straight tool, such as a flat chisel, a sharp chisel or a round shovel between them.

In the sharpening process, the straight tool to be grinded is clamped between the anvil block and the pressing block, or clamped between the anvil block and the bottom end of the knob without using the pressing block. The edge to be grinded of the straight tool is biased against the grinding stone. Further, the anvil block and the pressing block may be mounted in a vertical orientation or a horizontal orientation according to the requirement. Further, the outer surface of support frame may be provided with angle indicating lines which are disposed around the fastening screw. With reference to the angle indicating lines the ring body may be secured to the support frame at different angles, in order to adjust the lateral grinding angle of the tool to be grinded.

In another preferred embodiment of the invention, the tool rest of the electric sharpener is equipped with a flat shovel clamp, the flat shovel clamp comprises: an angular support which has two coaxial through holes for mounting the angular support to the tool rest; a plurality of knobs form securing the angular support to the tool rest; wherein the central axis of each of the knobs intersects with the central axis of the tool rest which inserts through the angular support.

In the sharpening process, a flat shovel is biased against the clamp with the front edge of the flat shovel being biased onto the grinding stone. As the flat shovel clamp and the flat shovel reciprocally moving on the tool rest, the front edge of the flat shovel is grinded by the rotated grinding stone. The displacement and vibration of the flat shovel will be avoided, and a high grinding quality and a high efficiency will be obtained.

The angular support may be formed as a single member by a sheet iron. Therefore, the flat shovel clamp may be produced in a simple machining process with a low cost.

In another preferred embodiment of the invention, the tool rest of the electric sharpener is equipped with a scissor clamp, the scissor clamp is to be mounted on the tool rest of the electric sharpener and comprises: an angular support which has two coaxial through holes for mounting the angular support to the tool rest; a plurality of guide rails fastened to the angular support by fastening screws; a scissor holder mounted against the guide rails by screws, form holding a pair of scissors; and a plurality of knobs form securing the angular support to the tool rest.

Preferably, the scissor holder comprises: a base plate, which is formed with a protruding handle; a plurality of triangular pressing plates, which are fastened by the screws to the base plate; and a plurality of screws for fixing the triangular pressing plates to the base plate, with a blade of a scissor between them.

In the sharpening process, the angular support is slidably and pivotably mounted on the transverse bar of the tool rest, and a scissor blade is be clamped by the scissor holder with the cutting edge of the blade being biased onto the grinding stone. As the scissor clamp reciprocally moving on the tool rest, the cutting edge of the blade is grinded by the rotated grinding stone. The displacement and vibration of the scissor blade will be avoided, and a high grinding quality and a high efficiency will be obtained.

Positioning pins may be used for aligning the pressing plates to the base plate, in order to avoid the displacement of the pressing plates.

In another preferred embodiment of the invention, the tool rest of the electric sharpener is equipped with a clamp for wide cutter, the clamp for wide cutter comprises: a plurality of posts attached to the main frame of the electric sharpener; a rail seat fixed to the posts; at least one guide rail fixed to the rail seat; a plurality of sliding blocks slidably mounted on the guide rail; a clamp body, which is fixed to the sliding blocks; a clamp seat, which is pivotably mounted to the clamp body; and a pressing plate, which is positioned relative to the clamp seat by screws, for clamping a wide cutter between them.

Preferably, the clamp body has a backside plate, the backside plate is formed with a threaded bore near its horizontal center, for engaging with a bolt, the clamp seat includes a tongue plate extending downwardly from its under surface, the end of the threaded portion of the bolt is biased against the tongue plate.

The grinding angle of the cutter may be adjusted by turning the bolt. Meanwhile, under the guide of the guide rail, the wide cutter clamped by the clamp can be moved horizontally, so as to completely grind the cutting edge of the wide cutter.

In another preferred embodiment of the invention, the tool rest of the electric sharpener is equipped with a knife clamp, the knife clamp comprises: a base member including a flat shovel shaped part at its front side and a handle at its rear side; a pressing plate mounted on the base member by a holding screw; and a retaining ring mounted on the middle portion of the base member, for biasing against the transverse bar of the tool rest.

In the sharpening process, a knife is clamped by the knife clamp. The grinding angle may be adjusted by changing the position of the retaining ring with respect to the base member. The retaining ring is supported by the transverse bar of the tool rest. As the knife clamp reciprocally moving on the tool rest, the cutting edge of the knife is grinded by the rotated grinding stone. The displacement and vibration of the knife will be avoided, and a high grinding quality and a high efficiency will be obtained.

In another preferred embodiment of the invention, a standard grinding-angle checking panel is set on the grinding stone, the checking panel is formed into a panel frame with a plurality of corners, each corner has at least one contacting edge to be contacted with the outer periphery surface of the grinding stone, with a prescribed specific angle form between the contacting edge and the outer periphery surface.

Preferably, the standard grinding-angle checking panel includes four corners, i.e. the first corner to the fourth corner, wherein when the first corner and the second corner are rested on the outer periphery surface of the grinding stone, an angle formed between the contacting edge of the first corner and the outer periphery surface is 30°, and an angle formed between the contacting edge of the second corner and the outer periphery surface is 25°; when the second corner and the third corner are rested on the outer periphery surface, an angle formed between the contacting edge of the second corner and the outer periphery surface is 60°, and an angle formed between the contacting edge of the third corner and outer periphery surface is 20°; and when the third corner and the four corner are rested on the outer periphery surface, an angle formed between the contacting edge of the third corner and outer periphery surface is 40°, and an angle formed between the contacting edge of the four corner and outer periphery surface is 25°.

Preferably, the most preferred grinding angles of typical tools are marked on the standard grinding-angle checking panel, and the angles that may be formed by the corners are marked near the corresponding corner.

Before the sharpening process, the grinding angle may be checked by the standard grinding-angle checking panel. If the grinding angle is not correct, then it may be adjusted.

According to the present invention, several prominent technical effects may be provided. The improved electric sharpener which can be widely used for grinding various woodworking or household tools such as lather tools, planer tools, scissors, chisels, axes, round shovels and flat shovels, and in which the grinding stone can be polished and trimmed. Further, the sharpener may provide one or more of the following advantages: having a simple, proper, compact and down-sized transmission system; creating less vibration and noise during operation; being able to be fitted with various clamps and attachments; being able to position and clamp the tools to be sharpened; can ensure the grinding angle and the grinding quality; having a high grinding efficiency; and being easy to operate.

BRIEF DESCRIPTION OF THE DRAWINGS

FIG. 8 is a perspective view showing a main part of a stone trimmer according to the second embodiment.

FIG. 9 is a view showing the operation of the stone trimmer.

FIG. 10 is a perspective view showing a profiled polishing disc mounted on the electric sharpener, according to the third embodiment.

FIG. 11 is a perspective view showing a clamp for woodworking lather tool according to the forth embodiment.

DETAILED DESCRIPTION OF THE PREFERRED EMBODIMENTS

The First Embodiment

Figure 2:
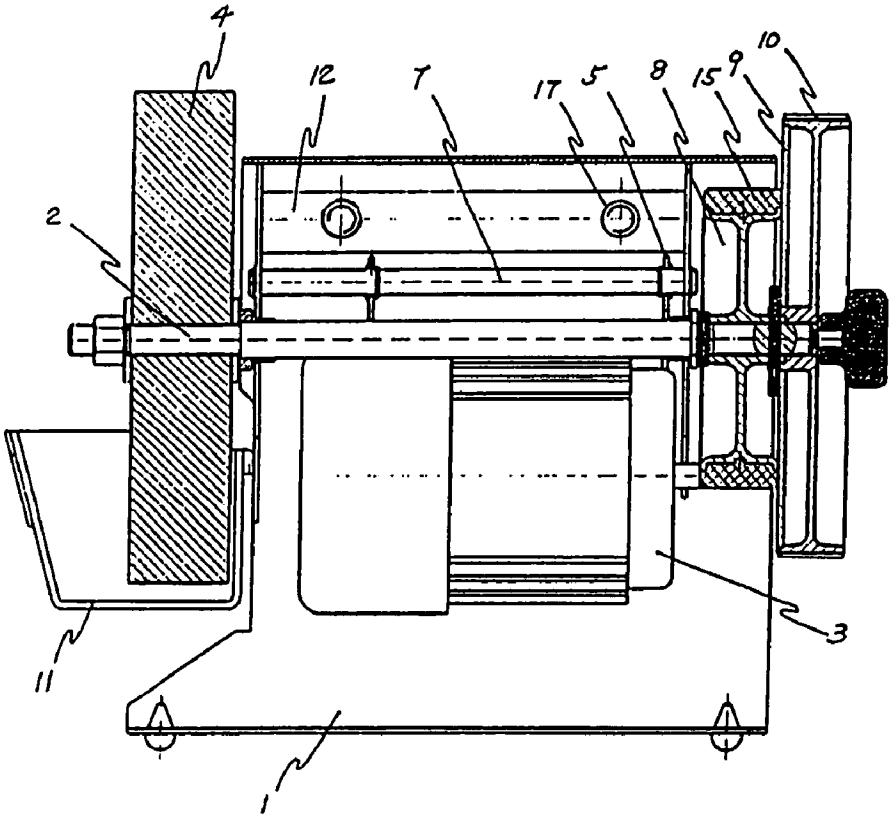
FIG. 2 is a front view of the electric sharpener with a leather honing wheel mounted thereon.
Figure 1:
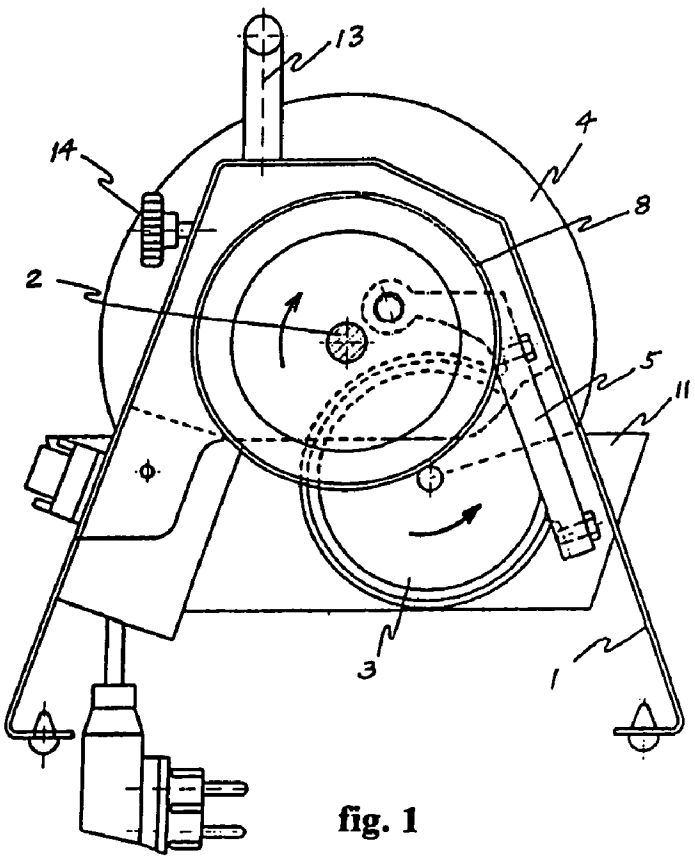
FIG. 1 is a right side view of the main part of an electric sharpener of the invention.
Figure 3:
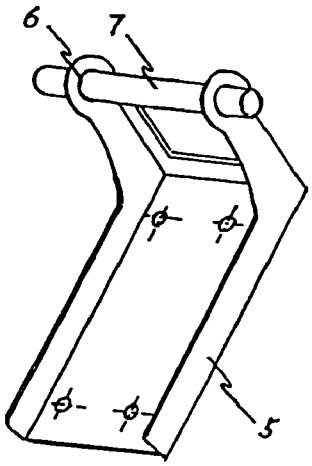
FIG. 3 is a perspective view of an angular frame and its shaft.

An electric sharpener of the invention, as shown in FIGS. 1 to 3, comprises a main frame 1, a main shaft 2 and a motor 3 mounted on the main frame 1, a transmission wheel 8 fixed to one end (right end in FIG. 1) of the main shaft for transmitting the rotation of the output shaft to the main shaft, a grinding stone 4 mounted on the other end of the main shaft 2, and an electric control circuit for controlling the sharpener. The motor 3 is mounted, at its base portion and by screws, on an angular frame 5 having two legs. The end of each leg of the angular frame 5 is provided with a mounting hole 6, through which a pivot shaft 7 is inserted, as shown in FIG. 3. The pivot shaft 7 is pivotably inserted into corresponding holes formed in the main frame 1, so that the motor 3 may pivot about the pivot shaft 7. The output shaft of the motor 3, owing to its weight, is pressed against the periphery of the transmission wheel 8 so as to drive it by friction force, as shown in FIG. 1. Further, in the arrangement shown in FIG. 1, the motor 3 is preferred rotates in an anti-clockwise direction, and the transmission wheel 8 is driven by the motor 3 in a clockwise direction. The end of the main shaft 2, where the transmission wheel 8 is mounted, further includes a leather honing wheel 9, which fixed onto it outside the transmission wheel 8. The outer periphery of the leather honing wheel 9 is covered with a layer of leather 10, preferably cow leather. The leather honing wheel is used to remove the void portions and the barbs of the tool edge.

The periphery of the transmission wheel 8 is covered with a rubber layer 15 for contacting with the output shaft of the motor 3. A water vessel 11 is fixed to the main frame 1, and the lower portion of the grinding stone 4 dips into the water contained in the water vessel 11.

Figure 4:
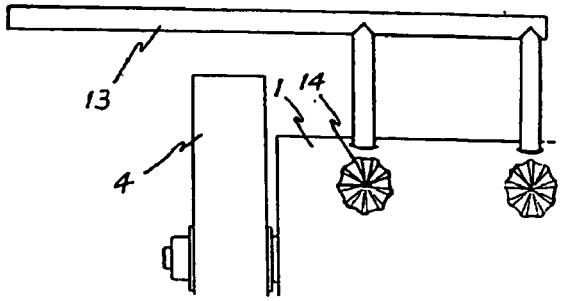
FIG. 4 is a front view of a tool rest of the first embodiment in a vertical mounting orientation.
Figure 5:
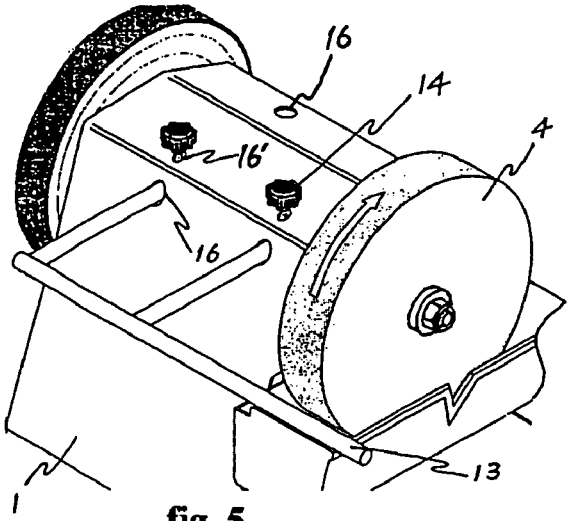
FIG. 5 is a backside perspective view of the tool rest of the first embodiment in a horizontal mounting orientation.

Referring to FIGS. 4 and 5, the electric sharpener may be equipped with a cantilever type tool rest 13 which includes a long transverse bar and two legs perpendicularly extended from the transverse bar.

Two pairs of mounting holes 16 are formed in the upper surface and the back surface of the main frame 1 respectively. Two pair of inserting holes 16' are formed in the upper surface and the front surface of the main frame 1. A supporting frame 12 (see FIG. 1) is fixed in the main frame 1. Two pair of threaded bores 17, which are coaxial with the inserting holes 16', are formed in the upper surface and the front surface of the supporting frame 12 respectively, with the central axes of the threaded bores 17 being perpendicular to that of the corresponding mounting holes 16. Further, two pairs of additional mounting holes (not shown), which are coaxial with the mounting holes 16, are formed in the upper surface and back surface of the supporting frame 12 respectively. Here, it may be understood that the term "front surface" refers to a surface face to a viewer when the electric sharpener is in a position shown in FIG. 1, while "back surface" refers to a surface face away from the viewer.

Each of the two legs of cantilever type tool rest 13 has an outer diameter less than the inner diameter of the mounting holes 16 and the additional mounting holes. The legs are inserted through a corresponding pair of mounting holes 16 and a corresponding pair of additional mounting holes, with the end portions of the legs exposed in the inside of the supporting frame 12. Two fastening screws 14 are inserted through a pair of inserting holes 16' (which are perpendicular to said mounting holes and the additional mounting holes), and are engaged into the corresponding threaded bores 17, with the end portions of the fastening screws exposed in the inside of the supporting frame 12 and forcefully pressed against the end portions of the legs of the tool rest 13, so as to fasten the cantilever type tool rest 13 onto the supporting frame 12. The legs may insert through any pair of the mounting holes 16, so as to provide two mounting orientations. FIG. 4 shows the tool rest 13 in a vertical mounting orientation, and FIG. 5 shows the tool rest 13 in a horizontal mounting orientation. The distance between the transverse bar of the tool rest and the main frame 1 may be adjusted and set by the fastening screws 14.

A skilled in the art could understand that the number of the legs is not limited to two. Three, four, or more legs may be provided for fixing the tool rest 13 to the main frame 1. Apparently, the number of the mounting holes 16, the inserting holes 16', the threaded bores 17 and the additional mounting holes may be choose according to the number of the legs and the desired mounting orientations of the tool rest.

Figure 6:
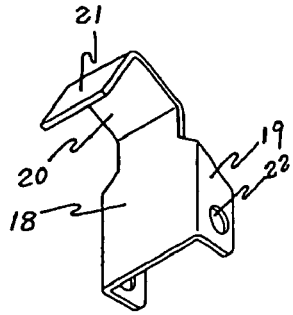
FIG. 6 is a perspective view of an axe clamp.
Figure 7:
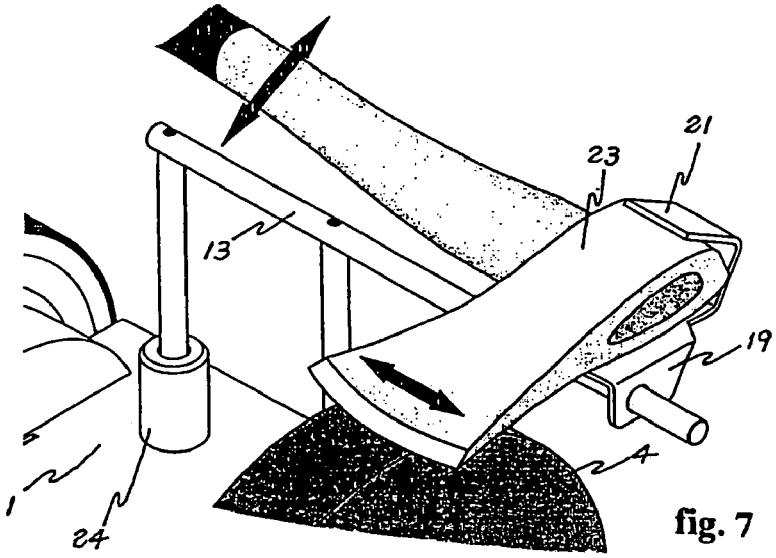
FIG. 7 is a view showing the operation of the axe clamp.

Referring to FIGS. 6 and 7, in the first embodiment, an axe clamp can be mounted on the tool rest 13. The axe clamp comprises a base plate part 18, right and left side plate parts 19 continued to the side edges of the base plate part 18, an upper bent plate part 20 continued to the upper edge of the base plate part 18, and a tongue plate part 21 continued to front edge of the upper bent plate part 20 and bent in a front downward direction. The right and left side plate parts 19 each has a through hole 22 by which the corresponding side plate part 19 may be mounted on the tool rest 13, with the two through holes 22 being coaxially arranged. An axe 23 may be clamped in the axe clamp by a pressing force created by the base plate part 18 and the tongue plate part 21. The axe clamp is slidable on the tool rest 13.

The tool rest 13 and the main frame 1 may be mounted by other equivalent ways. For instance, each of the upper surface and the back surface of the main frame 1 may be fixedly provided with a pair of leg mounting bases 24 each having a leg mounting hole. The lower end of each of the legs of the cantilever type tool rest 13 is inserted into a corresponding leg mounting hole of the leg mounting base 24 and is fastened by a corresponding fastening screw 14.

In the sharpening process, the axe 27 is clamped in the axe clamp, and the handle of the axe is held by an operator. The axe can wing as shown by the arrows of FIG. 7. The axe clamp can slide and pivot on the transverse bar of the tool rest. By the rotated grinding stone, the cutting edge of the axe will be grinded.

The Second Embodiment

In order to grind a tool with high quality, it is desired that the grinding stone have an evenly cylindrical outer periphery. However, a new grinding stone or a used stone may not have such an evenly cylindrical outer periphery. In this case, the grinding stone may be trimmed by a stone trimmer.

As shown in FIGS. 8 and 9, in the electric sharpener, a stone trimmer for trimming the outer periphery of the grinding stone is mounted on the tool rest 13 of the electric sharpener. The stone trimmer comprises a pencil-like lever 25 which is slidably and pivotably mounted on the transverse bar of the tool rest and a diamond cutting head 26 fixed to a longitudinal end (front end) of the lever 25. A transverse hole 27 is formed in the front part of the lever 25, for mounting the lever 25 onto the tool rest 13. The diamond cutting head 26 protrudes downwardly under the lever 25. Other parts of the electric sharpener are the same as that disclosed in the first embodiment.

As shown in FIG. 9, in the operation, a support strap 28 is fixed onto the tool rest 13 above the stone trimmer, so as to define a limited vertical pivot position for the stone trimmer (highest position of the back part of the lever 25 or lowest position of the diamond cutting head 26). The support strap 28 has side plates 29. Each of the side plate has a hole 30 for mounting the support strap 28 onto the tool rest 13. The support strap 28 has a upper plate having two threaded bores disposed at the right and left sides, with each of the threaded bore being engaged with a knob 31 having outer threads. After the angle and position of the support strap 28 having been properly adjusted, the knob 31 is fastened by turning it, so as to fasten the support strap 28 onto the tool rest 13. With the support strap 28 being fixed, the stone trimmer may be moved in the right and left directions under the limitation of the support strap, and the outer periphery surface of the grinding stone may be trimmed by the diamond cutting head 26 into a evenly cylinder shape and parallel to the tool rest.

In the second embodiment, the stone trimmer may be mounted onto the tool rest 13 with its vertical position being limited by the support strap. Therefore, the diamond cutting head may evenly cut into the outer periphery surface of the grinding stone, so as to avoid the random displacement and vibration which may be met when holding the stone trimmer only by hand. As a result, the grinding stone 4 may be trimmed to have a shape of a high quality with high trimming efficiency.

The Third Embodiment

In the electric sharpener as shown in FIG. 10, a profiled polishing disc is mounted on the main shaft 2 outside of the water vessel 11 by a nut 32 and a spacer. The profiled polishing disc has a disc body 33 and a leather layer 34 which covers the outer periphery of the disc body 33. The outer periphery of the disc body 33 is formed with a rotary recess surface 36 having a shape corresponding to the outer shape of a tool 35 to be polished, so that the outer surface can be polished without any part being unpolished. Other parts of the electric sharpener are the same as that disclosed in the first embodiment. The leather, preferably cow leather, has a high toughness, a high mechanical strength, and a high wearing resistance, which result in a long service life. Meanwhile, as the leather has a high material quality in addition to its high mechanical strength, the third embodiment may provide an excellent polishing effect.

The Forth Embodiment

Figure 12:
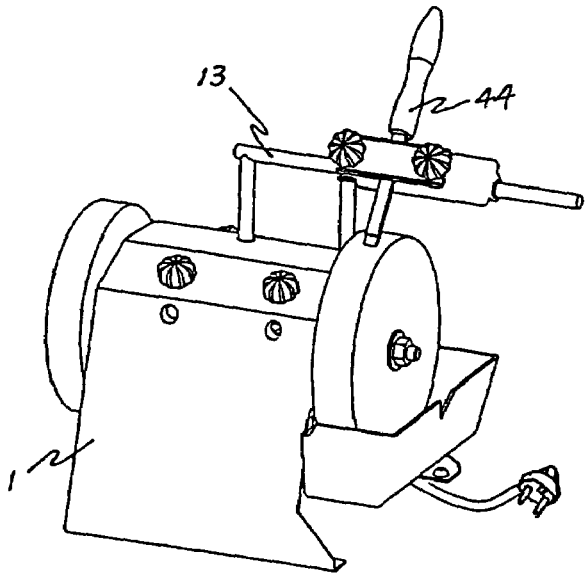
FIG. 12 is a perspective view showing the operation of the clamp for woodworking lather tool.

As shown in FIGS. 11 and 12, the tool rest 13 of the electric sharpener may be equipped with a clamp for woodworking lather tool. This clamp has a base plate 38 having two threaded bores 37 formed therethrough, two knobs 39 each having a threaded lower portion for engaged in a corresponding threaded bore 37 of the base plate 38, a pressing plate 40 mounted between a shoulder portion of the knobs 39 and the upper surface of the base plate 38, and two compressing springs 41 each surrounding the threaded lower portion of a corresponding knob 39 between the pressing plate 40 and the base plate 38. Right and left supports 42 protruded downwardly from the base plate 38. Each of the right and left supports 42 has a through hole 43 for mounting the clamp to the tool rest 13. Other parts of the electric sharpener are the same as that disclosed in the first embodiment. A woodworking lather tool 44 is clamped by the clamp of this embodiment, as shown in FIG. 12.

The Fifth Embodiment

Figure 13:
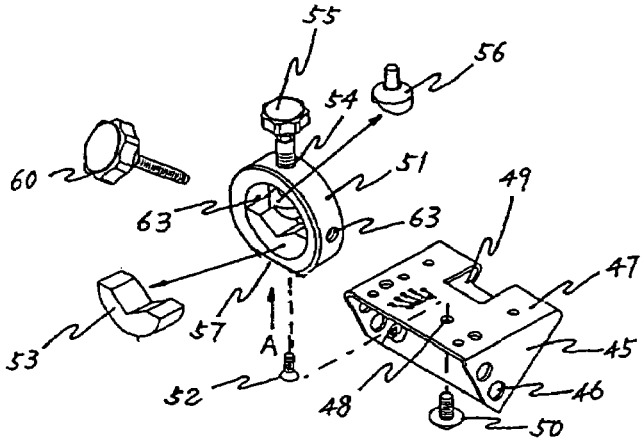
FIG. 13 is an exploded perspective view showing a general shovel clamp according to the fifth embodiment.

As shown in FIG. 13, the tool rest 13 of the electric sharpener can be equipped with a general shovel clamp. The clamp comprises a support frame 49, a ring body 51, an anvil block 53, a knob 55, a pressing block 56, and another knob 60. The support frame has two side plate parts 45 having coaxial through holes 46 formed in them, an upper plate part 47 having attaching holes 48 formed in it, and a underside plate connected to the side plate parts 45 and the upper plate part 47. The ring body 51 is secured to the support frame by a fastening screw 50 which inserts through the attaching holes 48 and engages in a threaded bore 59 formed in the ring body 51. The anvil block 53 has an angular concave surface and is fixed in the ring body 51 by a sunk screw 52. The knob 55 has a threaded portion which is provided with outer threads on its outer periphery and an inner hole in its bottom end face. The threaded portion of the knob 55 is engaged in a threaded bore 54 provided through the ring body 51 from an opposite position to the sunk screw 52. The pressing block 56 has an angular concave surface which faces the angular concave surface of the anvil block, and an upright portion to be inserted into the inner hole of the knob 55. The ring body 51 has a flat bottom surface 57.

Figure 14:
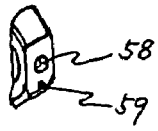
FIG. 14 is a partial perspective view made from the direction shown by the arrow "A" in FIG. 13.

Referring to FIG. 14, the bottom surface 57 is formed with a threaded bore 58 on its vertical central axis to be engaged with the sunk screw 52. The threaded bore 59 is displaced from said vertical central axis, to be engaged with the fastening screw 50 for fastening the ring body 51 to the support frame 49. The ring body 51 is also provided with two threaded bores 63 on its horizontal central axis which is perpendicular to the vertical central axis, to be engaged with another screw 52 and another knob 60, so as to mounting the anvil block 53 and the pressing block 56 in an horizontal orientation. The outer surface of the upper plate part 47 may be provided with angle indicating lines which are disposed around the fastening screw 50, as shown in FIG. 13. With reference to the angle indicating lines the ring body 51 may be secured to the support frame at different angles, in order to adjust the lateral grinding angle of the tool to be grinded. Other parts of the electric sharpener are the same as that disclosed in the first embodiment.

In the sharpening process, a straight tool to be grinded is clamped between the anvil block and the pressing block, or clamped between the anvil block and the bottom end of the knob 55 without using the pressing block.

Figure 15:
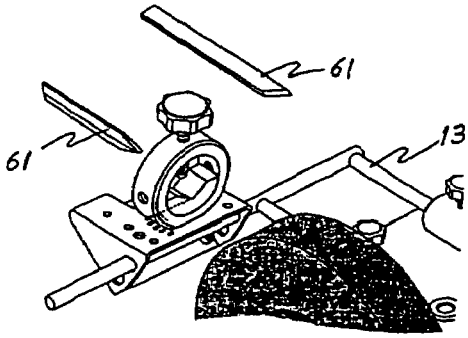
FIG. 15 is a perspective view showing the operation for grinding a flat chisel or a sharp chisel.

FIG. 15 shows the electric sharpener of the fifth embodiment for grinding a flat chisel 61 or a sharp chisel 61' which is clamped between the pressing block 56 or the bottom end of the knob 55 and the anvil block 53. The ring body 51 is secured to the support frame 49, and the support frame 49 is in turn pivotally and slidably mounted on the tool rest 13.

Figure 16:
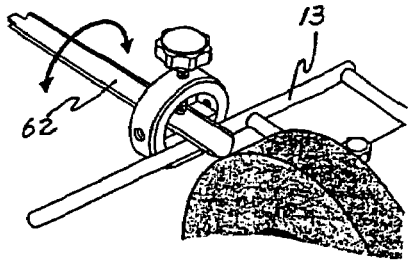
FIG. 16 is a perspective view showing the operation for grinding a round shovel.

FIG. 16 shows the electric sharpener of the fifth embodiment for grinding a round shovel 62. In this case, the support frame 49 is not used. The round shovel 62 is clamped between the pressing block 56 or the bottom end of the knob 55 and the anvil block 53. The round shovel 62 is directly supported by the transverse bar of the tool rest and is able to roll on the transverse bar.

The Six Embodiment

Figure 17:
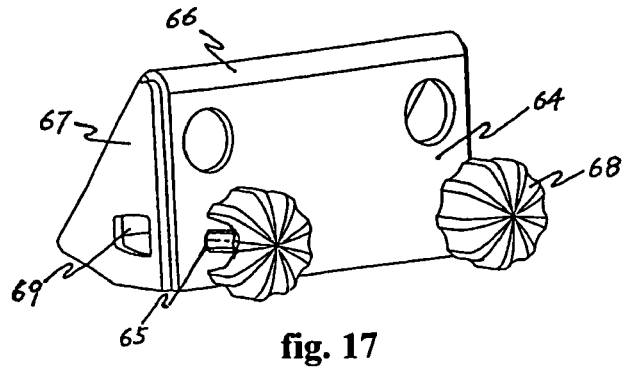
FIG. 17 is a perspective view showing a flat shovel clamp according to the sixth embodiment.
Figure 18:
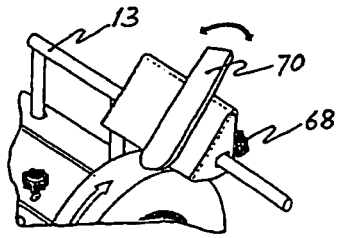
FIG. 18 is a perspective view showing the operation of the flat shovel clamp.

As shown in FIGS. 17 and 18, the tool rest 13 of the electric sharpener can be equipped with a flat shovel clamp. The flat shovel clamp comprises an angular support 66 and two knobs 68. The angular support 66 has a front plate part, a back plate part 64 continued to the front plate part forming an angle between them and right and left side plate parts 67. Two threaded bores 65 formed in the back plate part 64 near the two sides of it. The right and left side plate parts 67 are fixedly connected to the sides of the front plate part and the back plate part of the angular support 66. Each of the knobs 68 has a threaded portion to be engaged into one of the threaded bores 65. The right and left side plate parts 67 are formed with coaxial holes 69 for mounting the clamp to the tool rest 13, with the central axis of each of the knobs 68 intersects with the central axis of the tool rest 13 which inserts through the holes 69 of the right and left side plate parts 67. The angular support 66 is formed as a single member by a sheet iron. A flat shovel 70 to be grinded is biased against the clamp. The flat shovel 70 is held by an operator and can swing as shown by the arrow of FIG. 18. Other parts of the electric sharpener are the same as that disclosed in the first embodiment.

The Seventh Embodiment

Figure 19:
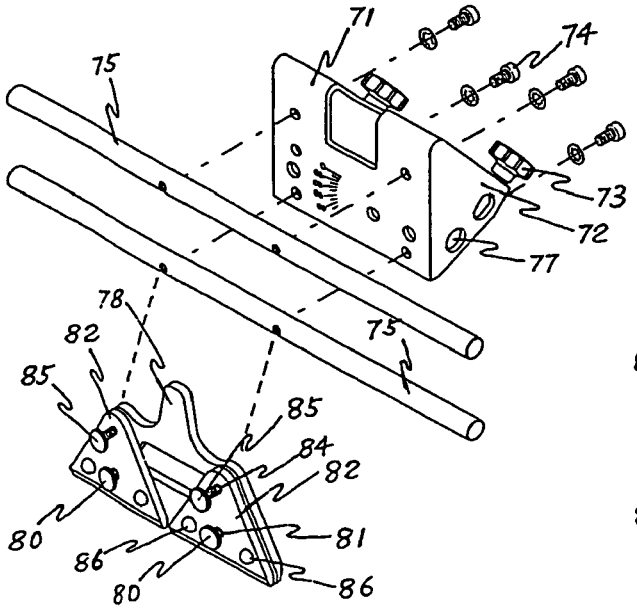
FIG. 19 is an-exploded perspective view showing a scissor clamp according to the seventh embodiment.
Figure 20:
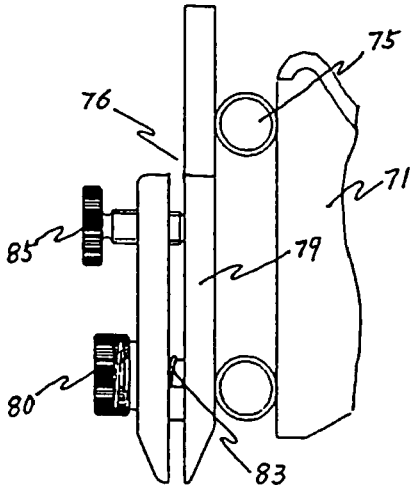
FIG. 20 is a side view of a scissor holder.

As shown in FIGS. 19 and 20, the tool rest 13 of the electric sharpener can be equipped with a scissor clamp. The scissor clamp is to be mounted on the tool rest 13 of the electric sharpener and comprises an angular support 71, two guide rails 75, a scissor holder 76, and two knobs 73. The angular support 71 has a front plate part, a back plate part continued to the front plate part forming an angle between them and right and left side plate parts 72 connected to the front plate part and the back plate part. Two threaded bores formed in the back plate part near the two sides of it. Each of the knobs 73 has a threaded portion to be engaged into one of the threaded bores of the angular support 71. Each of the two parallel guide rails 75 is fastened to the front plate part by two fastening screws 74. The scissor holder 76 is mounted against the two guide rails 75 by screws. The right and left side plate parts 72 are formed with coaxial holes 77, for mounting the clamp to the tool rest 13, with the central axis of each of the knobs 73 intersects with the central axis of the tool rest 13 which inserts the holes 77 of the right and left side plate parts 72.

The scissor holder 76 comprises: a base plate 79, which is formed with a protruding handle 78; two screws 80, which are engaged in the threaded bores provided through the right and left sides of the base plate 79; two triangular pressing plates 82, which are fastened by the screws 80 to the right and left sides of the base plate 79; two compressing springs 83, each of them surrounds a corresponding screw 80 between the triangular pressing plates 82 and the base plate 79, two setting screws 85, each of which is engaged in a threaded bore 84 formed in a corresponding triangular pressing plate 82; and two pairs of positioning pins 86, each pair of which are fixed along the bottom edge of the base plate 79 on the opposite sides of the vertical central line of a corresponding triangular pressing plate 82. The four positioning pins 86 insert through the corresponding holes formed in the triangular pressing plate 82. A lower threaded hole 81 for engaging with the screw 80 and the upper threaded bore 84 are provided on the vertical central line of the triangular pressing plate 82.

A scissor blade may be clamped between the lower end of the triangular pressing plate(s) 82 and the lower end of the base plate 79. The distance between the triangular pressing plate 82 and the base plate 79 may be adjusted by turning the screw 80, while the angle formed between them may be adjusted by turning the setting screw 85. The is to say, turning the setting screws 85 out may cause the angel increased, while turning the setting screws 85 in may cause the angel decreased. In this way, the scissor blade may be clamped.

Figure 21:
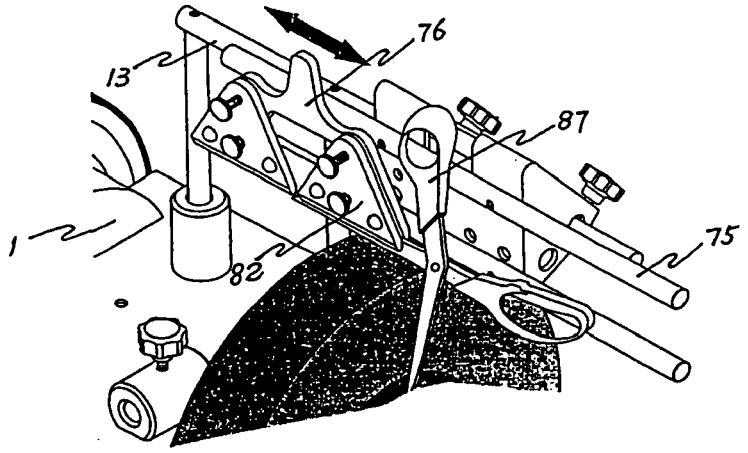
FIG. 21 is a perspective view showing the operation for grinding scissors.

As shown in FIG. 21, a scissor blade is clamped by the scissor holder 76, with the scissor holder 76 being fastened against the guide rails 75. As the scissors 87 moves to the right and left with the scissor clamp, the cutting edge is grinded. If the scissors 87 are small, only one triangular pressing plate 82 can be used for clamping the cutting edge. If the scissors 87 are large, two triangular pressing plates 82 are needed for clamping the cutting edge. Other parts of the electric sharpener are the same as that disclosed in the first embodiment.

The Eighth Embodiment

Figure 22:
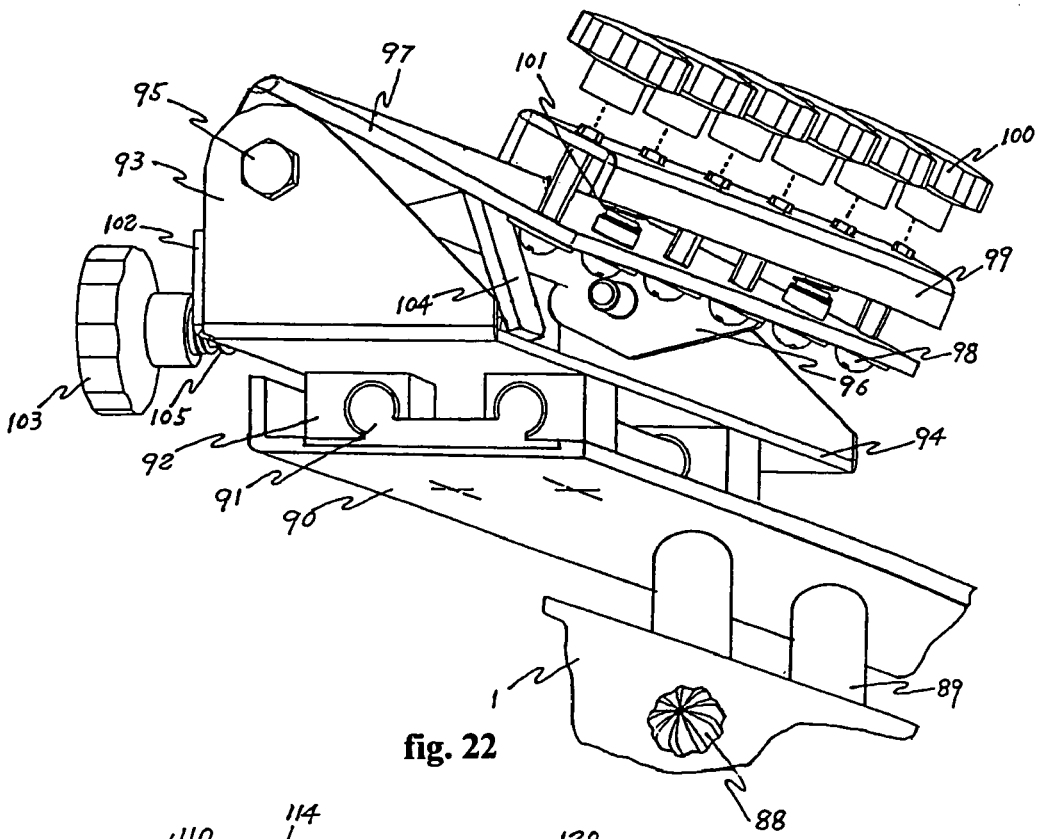
FIG. 22 is a perspective view showing a clamp for wide cutter according to the eighth embodiment.

In the electric sharpener shown in FIG. 22, a clamp for wide cutter can be mounted on the tool rest 13 of the electric sharpener by mounting holes. The clamp for wide cutter comprises: two posts 89, which are attached to the main frame of the electric sharpener by fastening screws 88; a rail seat 90 fixed to the posts 89; two guide rails 91 fixed to the rail seat 90; four sliding blocks 92 slidably mounted on the guide rails 91; a clamp body 94, which is fixed to the four sliding blocks 92 by screws and is provided with pivot plates 93 at its right and left sides, each of the pivot plates 93 being provided with a pivot hole; a pivot shaft 95 mounted through the pivot holes of the pivot plates; a clamp seat 97, which includes two side surfaces 96 formed with mounting holes for pivotably mount the clamp seat onto the pivot shaft 95; a row of screws 98 inserted through a row of holes formed in the lower part of the clamp seat 97, with the threaded portion of the screws 98 pointed upwardly; a pressing plate 99, which is inserted through by the threaded portion of the screws 98; a row of nuts 100, each of which is engaged with one of screws 98 and has a shoulder; tightening springs 101 surrounding the threaded portions of the screws 98 between the clamp seat 97 and the pressing plate 99. Only two tightening springs are provided in this embodiment.

The clamp body 94 has a backside plate 102. The backside plate 102 is formed with a threaded bore near its horizontal center, for engaging with a bolt 103. The clamp seat 97 includes a tongue plate 104 extending downwardly from its under surface. The end of the threaded portion of the bolt 103 is biased against the tongue plate 104. The threaded portion of the bolt 103 is surrounded by a compressing spring 105 which is comprised between the head portion of the bolt 103 and the backside plate 102 of the clamp body 94. Other parts of the electric sharpener are the same as that disclosed in the first embodiment.

By turning the nuts 100, the distance between the clamp seat 97 and the pressing plate 99 may be adjusted, and in this way, a wide cutter may be clamped between the clamp seat 97 and the pressing plate 99.

When the cutting edge of the cutter is biased against the grinding stone, the grinding angle formed between the cutting edge and the grinding stone may be adjusted by the bolt 103. That is to say, by turning the bolt 103 in, the end of the threaded portion of the bolt 103 will push the tongue plate 104 moving outwardly, so that the clamp seat 97 will move in an opening direction. On the other hand, by turning the bolt 103 out, the clamp seat 97 will move in a closing direction by its weight.

Under the guide of the guide rails 91, the wide cutter clamped by the clamp can be moved horizontally, so as to completely grind the cutting edge of the wide cutter.

The Ninth Embodiment

Figure 23:
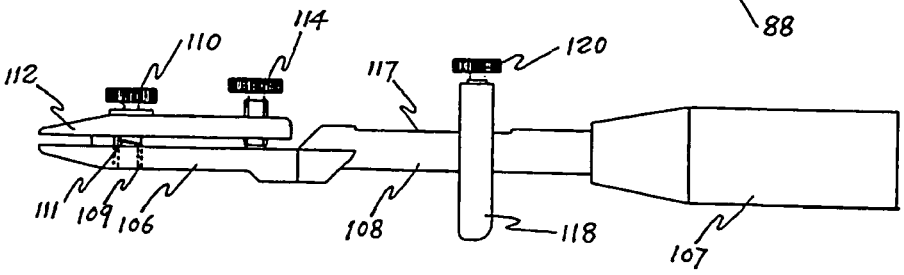
FIG. 23 is a front view showing a knife clamp according to the ninth embodiment.
Figure 24:
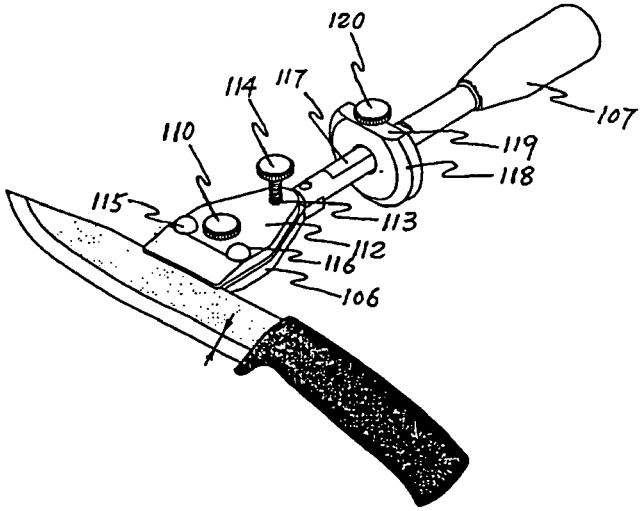
FIG. 24 is a perspective view showing the knife clamp when clamping a knife.
Figure 25:
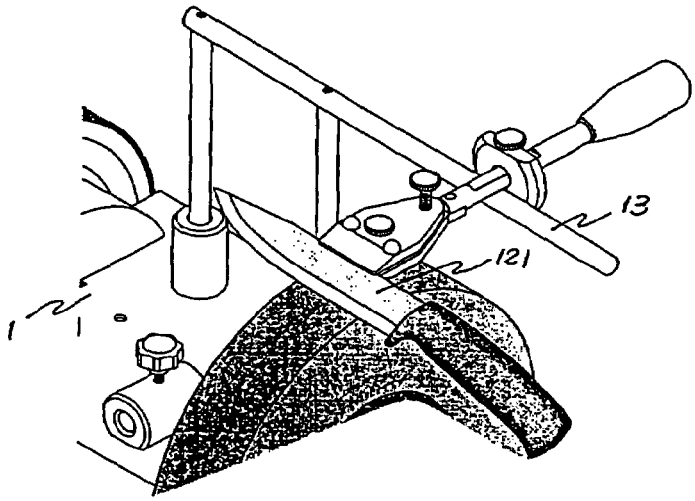
FIG. 25 is a perspective view showing the operation for grinding the knife.

As shown in FIGS. 23 to 25, the tool rest 13 of the electric sharpener can be equipped with a knife clamp. The knife clamp comprises: a base member 108 including a flat shovel shaped part 106 at its front side and a handle 107 at its rear side; a holding screw 110 engaged in a threaded bore 109 formed across the central axis of the base member 108 near its front end; a pressing plate 112 mounted on the base member 108 by a hole formed across its central axis and inserted through by the holding screw 110; a compressing spring 111 surrounding the threaded portion of the holding screw 110 between the pressing plate 112 and the base member 108; a setting screw 114 engaged in a threaded bore 113 formed across the central axis of the pressing plate 112; and two positioning pins 115 fixed at the opposite sides of the central axis of the front flat shovel shaped part 106 of the base member 108. The two positioning pins 115 insert through the holes 116 formed in the pressing plate 112.

A flat surface 117 is formed on the upper middle of the base member 108. A retaining ring 118 is mounted on the flat surface at the middle of the base member 108. The outer periphery of the retaining ring 118 is formed with a flat surface 119. The flat surface 119 has a threaded bore formed in its middle portion, for engaging with a fastening screw 120. The end of the threaded portion of the screw 120 is biased against the middle flat surface 117 of the base member 108.

The distance between the pressing plate 112 and the flat shovel shaped part 106 may be adjusted by turning the holding screw 110, while angle formed between them may be adjusted by turning the setting screw 114. In this way, a knife 121 can be clamped between the tip ends of the pressing plate 112 and the flat shovel shaped part 106.

As shown in FIG. 25, the knife 121, preferably a table knife, is clamped by the knife clamp of this embodiment, and the retaining ring 118 of the knife clamp is cooperatively biased against the tool rest 13 of the electric sharpener, so as to grinding the cutting edge of the knife. The retaining ring 118 is rest on the transverse bar of the tool rest. By changing the position of the retaining ring 118 on the middle flat surface 117 of the base member 108, the grinding angle may be adjusted.

The Tenth Embodiment

Figure 26:
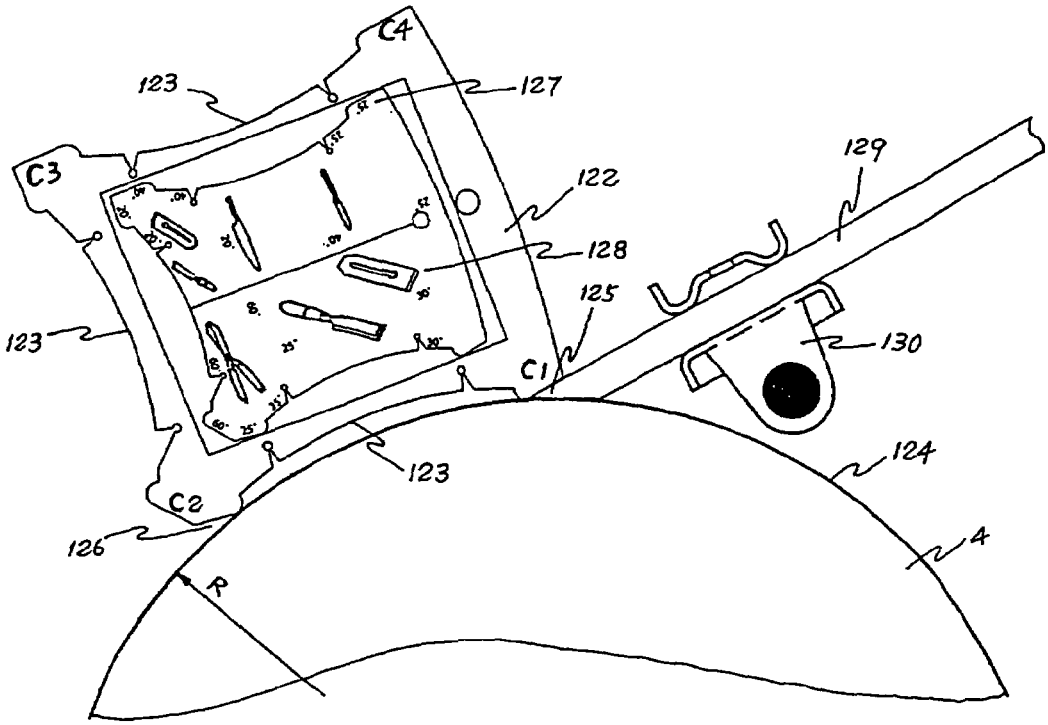
FIG. 26 is a perspective view showing a standard grinding-angle checking panel according to the tenth embodiment and its operation state.

In the electric sharpener shown in FIG. 26, a standard grinding-angle checking panel is set on the grinding stone. The checking panel is formed into a panel frame 122 with four corners, i.e. the first corner C1 to the fourth corner C4. Recesses 123 are formed between the first corner C1 and the second corner C2, between the second corner C2 and the third corner C3 and between the third corner C3 and the four corner C4. During the checking, two corners will contact the outer periphery surface 124 of the grinding stone 4, which has a radius R.

When the first corner and the second corner are rested on the outer periphery surface 124 of the grinding stone 4, an angle 125 formed between the contacting edge of the first corner and the outer periphery surface 124 is 30°, and an angle 126 formed between the contacting edge of the second corner and the outer periphery surface 124 is 25°. When the second corner and the third corner are rested on the outer periphery surface 124, an angle formed between the contacting edge of the second corner and the outer periphery surface 124 is 60°, and an angle formed between the contacting edge of the third corner and outer periphery surface 124 is 20°. When the third corner and the four corner are rested on the outer periphery surface 124, an angle formed between the contacting edge of the third corner and outer periphery surface 124 is 40°, and an angle formed between the contacting edge of the four corner and outer periphery surface 124 is 25°. Reference number 127 indicates the angle that may be formed by the corresponding corner, which facilitates the checking of the grinding angle. Reference number 128 indicates the most preferred grinding angles of some typical tools.

Before the sharpening process, according to the desired grinding angle of the tool to be grinded, the standard grinding-angle checking panel is set on the non-rotated grinding stone with two corresponding corners contacting the grinding stone. The corner, which forms the desired grinding angle between its edge and the outer periphery surface, is biased against the back face of the cutting edge, to check the grinding angle. Specifically, if the edge of the corner coincides with the back face of the cutting edge, the grinding angle is correct, and the grinding process may be started. Otherwise, the grinding angle is not correct and should be adjusted.

FIG. 26 further shows a tool 129 to be grinded and a clamp 130 for clamping the tool onto the electric sharpener.

With the structures disclosed in the first to the tenth embodiment, several prominent technical effects may be provided. The improved electric sharpener which can be widely used for grinding various woodworking or household tools such as lather tools, planer tools, scissors, chisels, axes, round shovels and flat shovels, and in which the grinding stone can be polished and trimmed. Further, the sharpener may provide one or more of the following advantages: having a simple, proper, compact and down-sized transmission system; creating less vibration and noise during operation; being able to be fitted with various clamps and attachments; being able to position and clamp the tools to be sharpened; can ensure the grinding angle and the grinding quality; having a high grinding efficiency; and being easy to operate.

The invention claimed is:

1. An electric sharpener, comprising:

(a) a main frame;

(b) a main shaft and a motor with an output shaft mounted on the main frame;

(c) a transmission wheel fixed to the main shaft;

(d) a grinding stone mounted on the main shaft; and (e) a cantilever type tool rest fixed to the main frame, said tool rest having a general shovel clamp which includes:

(1) a base plate having a plurality of threaded bores formed therethrough;

(2) a plurality of knobs each having a threaded lower portion engaged in a corresponding threaded bore of the base plate;

(3) a pressing plate mounted between a shoulder portion of the knobs and the upper surface of the base plate; and (4) a plurality of compressing springs each surrounding the threaded lower portion of a corresponding knob between the pressing plate and the base plate;

wherein the base plate includes right and left supports protruded downwardly from it, each of the right and left supports having a through hole for mounting the clamp to the tool rest;

wherein the motor is mounted on an angular frame having two legs, the end of each leg being provided with a mounting hole through which a pivot shaft is inserted, the pivot shaft being pivotably mounted on the main frame, so that the motor may pivot about the pivot shaft; and wherein the output shaft of the motor, owing to its weight, is pressed against the periphery of the transmission wheel so as to drive the transmission wheel by friction force.

2. The electric sharpener according to claim 1, wherein a water vessel is fixed to the main frame, and the lower portion of the grinding stone dips into the water contained in the water vessel.

3. The electric sharpener according to claim 1, wherein the tool rest includes a long transverse bar and a plurality of legs perpendicularly extended from the transverse bar;

a plurality of mounting holes are formed in the upper surface and the back surface of the main frame, and a plurality of inserting holes are formed in the upper surface and the front surface of the main frame;

a supporting frame is fixed in the main frame, wherein a plurality of threaded bores, which are coaxial with the inserting holes, are formed in the upper surface and the front surface of the supporting frame, with the central axes of the threaded bores being perpendicular to that of the corresponding mounting holes, and a plurality of additional mounting holes, which are coaxial with the mounting holes, are formed in the upper surface and back surface of the supporting frame; and the legs are inserted through the corresponding mounting holes and the corresponding additional mounting holes, with the end portions of the legs exposed in the inside of the supporting frame, a plurality of fastening screws are inserted through the inserting holes, and are engaged into the corresponding threaded bores, with the end portions of the fastening screws exposed in the inside of the supporting frame and forcefully pressed against the end portions of the legs of the tool rest, so as to fasten the tool rest onto the supporting frame in different mounting orientations, which include at least a vertical and a horizontal mounting orientations.

4. The electric sharpener according to claim 1, wherein the transmission wheel has a periphery which is covered with a rubber layer.

5. The electric sharpener according to claim 1, wherein a leather honing wheel is mounted on the main shaft, and an outer periphery of the leather honing wheel is covered with a layer of leather.

6. The electric sharpener according to claim 1, wherein a profiled polishing disc is mounted on the main shaft, and the profiled polishing disc has a disc body and a leather layer which covers an outer periphery of the disc body.

* * * * *